United States Patent [19]

Malkki et al.

[11] Patent Number: 4,634,068

[45] Date of Patent: Jan. 6, 1987

[54] METHOD FOR CONTROLLING PAPER WEB REEL-UP

[75] Inventors: Raimo Malkki, Lappeenranta; Antti Kuisma, Jyväskylä; Matti Verkasalo, Oulu, all of Finland

[73] Assignees: Valmet Oy; Oy Kaukas AB, both of Finland

[21] Appl. No.: 803,106

[22] Filed: Nov. 27, 1985

[30] Foreign Application Priority Data

Nov. 27, 1984 [FI] Finland ..... 844652

[51] Int. Cl.[4] ..... B65H 18/16

[52] U.S. Cl. ..... 242/65

[58] Field of Search ..... 242/55, 56 R, 56 A, 242/56.5, 56.6, 58.6, 68.7, 65

[56] References Cited

U.S. PATENT DOCUMENTS

| | | | |
|---|---|---|---|
| 2,176,198 | 10/1939 | Berry | 242/65 |
| 2,703,683 | 3/1955 | Evans et al. | 242/65 |
| 3,116,031 | 12/1963 | Moore et al. | 242/65 |
| 3,191,883 | 6/1965 | Wells | 242/56 R |
| 3,202,374 | 8/1965 | Phelps | 242/65 |
| 3,258,217 | 6/1966 | MacArthur et al. | 242/65 |
| 4,390,138 | 6/1983 | Rohde et al. | 242/55 |
| 4,546,930 | 10/1985 | Rohde et al. | 242/56 R |

*Primary Examiner*—John M. Jillions
*Attorney, Agent, or Firm*—Steinberg & Raskin

[57] ABSTRACT

A method for controlling paper web reel-up, particularly in a Pope-type reel-up apparatus, wherein a reeling cylinder provides power to a paper web reel being formed on a reeling drum at a nip formed between the periphery of the reeling cylinder and the periphery of the web reel being formed. The reeling operation is begun with the reeling drum held in primary forks. The reeling drum and inner section of the web reel formed on it are removed from the primary forks and delivered to secondary forks in which the final steps of the reeling operation are carried out. The primary and secondary forks are coupled to power equipment by which the loading of the power-transmitting nip is generated. In accordance with the invention, the nip loading force provided by the power equipment during the reeling operation is adjusted by control signals determined by the position of the primary and secondary forks in a manner such that a substantially even load distribution will occur even in the exchange step in which the reeling drum and web reel being formed on it are moved from the support of the primary forks to the support of the secondary forks.

9 Claims, 6 Drawing Figures

METHOD FOR CONTROLLING PAPER WEB REEL-UP

BACKGROUND OF THE INVENTION

This invention relates to methods for controlling the reel-up operation of paper webs, particularly in Pope-type reel-up apparatus.

Pope-type reel-up apparatus include a reeling cylinder by which power is provided to a web reel being formed on a reeling drum through a nip formed between the periphery of the reeling cylinder and the periphery of the web reel being formed. In the reeling operation, the inner section of the web reel is formed on the reeling drum which is held on primary forks or the like whereupon the reeling drum and section of the web reel formed thereon are removed to secondary forks on which the final steps of the reeling operation are carried out. The loading of the power-transmitting nip is at least mainly provided by power equipment coupled to the primary and secondary forks.

Pope-type reel-up apparatus are commonly used for reeling paper web from equipment such as paper machines, coating machines, supercalenders and printing machines. In such apparatus, the web is reeled onto a drum and the web reel being formed is pressed against a Pope-type or reeling cylinder over a sector of which the web runs and which rotates at a peripheral speed which corresponds to the desired web speed. Before the web reel is completed, a new reeling drum may be brought into nip contact with the Pope cylinder after the reeling is accellerated to the proper running speed. As soon as the web reel attains the desired diameter, it is separated from the Pope cylinder so that its rotational speed decreases causing a web loop to form between the new reeling drum and the completed web reel. This loop is guided such, for example, as by means of a compressed air jet, to be wound around the new reeling drum whereupon the web is torn from the completed web reel.

In connection with the state of the art, reference is made to U.S. Pat. Nos. 2,176,198, 2,703,683, 3,116,031, 3,191,883, 3,202,374, 3,258,217 and 3,743,199.

A problem inherent in high speed web reeling operations using Pope-type or similar reel-up apparatus, is that folds are created in the inner layers of the web reels so that their bottom sections must be discarded. This problem is especially serious in connection with the reeling-up of LWC and SC paper qualities. The amount of such rejects may be as high as 2 to 3% which causes considerable economical loss to the paper mill. The main reason for the formation of such folds or wrinkles in the inner layers of the web reels is the variation of hardness or density in the bottom part of the reels which, in general, is caused by uncontrolled variations of the linear loading at the nip formed between the paper reel and the Pope cylinder and, additionally, by variations of the tightness of the paper web as discussed below.

Two main factors influence the hardness or density distribution of a paper or web reel reeled by a Pope-type reel-up apparatus, namely, firstly, the linear loading between the reeling cylinder and the paper reel and, secondly, the tightness of the web during the reeling operation which is a function of the speed differential between the calander and the reel-up apparatus. Uncontrolled variations in the hardness distribution with discontinuities therein cause problems in subsequent steps in the reeling-up operation and, in the worst case, tears and folds are created near the bottom of the reel. The present invention has as its main object the solution to these drawbacks caused by uncontrolled variations in the linear loading between the paper reel and the Pope cylinder.

SUMMARY OF THE INVENTION

Accordingly, it is an object of the present invention to provide new and improved methods for controlling a paper web reel-up operation which overcomes the drawbacks of conventional methods as discussed above.

Briefly, in accordance with the present invention, the nip-loading forces provided by the power equipment coupled to the primary and secondary forks which support the reeling drum on which the web reel is wound is controlled by signals determined by the position of the forks in a manner such that the force distribution present in the nip is controlled even during the exchange step in which the reeling drum and paper reel being formed around it is moved from the support and loading of the primary forks to the support and loading of the primary forks to the support and loading of the secondary forks.

An advantage of the method of control of the invention relative to conventional methods of control is that in accordance with the invention, the exchange step is made to be more reliable than has been possible heretofore. The paper web may be removed from the completed paper reel onto an empty reeling drum set up in the exchange position using conventional techniques. Thus, a typical feature of all exchange operations is that the reliability of the exchange is improved with the number of breaks which occur during the exchange being reduced, if the linear loading between the reeling drum and the reeling cylinder is substantially even or somewhat higher in the middle section of the web than in the edge sections. In an arrangement in accordance with the invention, the linear loading and transverse load distribution can be adjusted as desired at the very moment when the web is exchanged from one drum to another by using unloading cylinders acting on the primary forks as described below.

DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
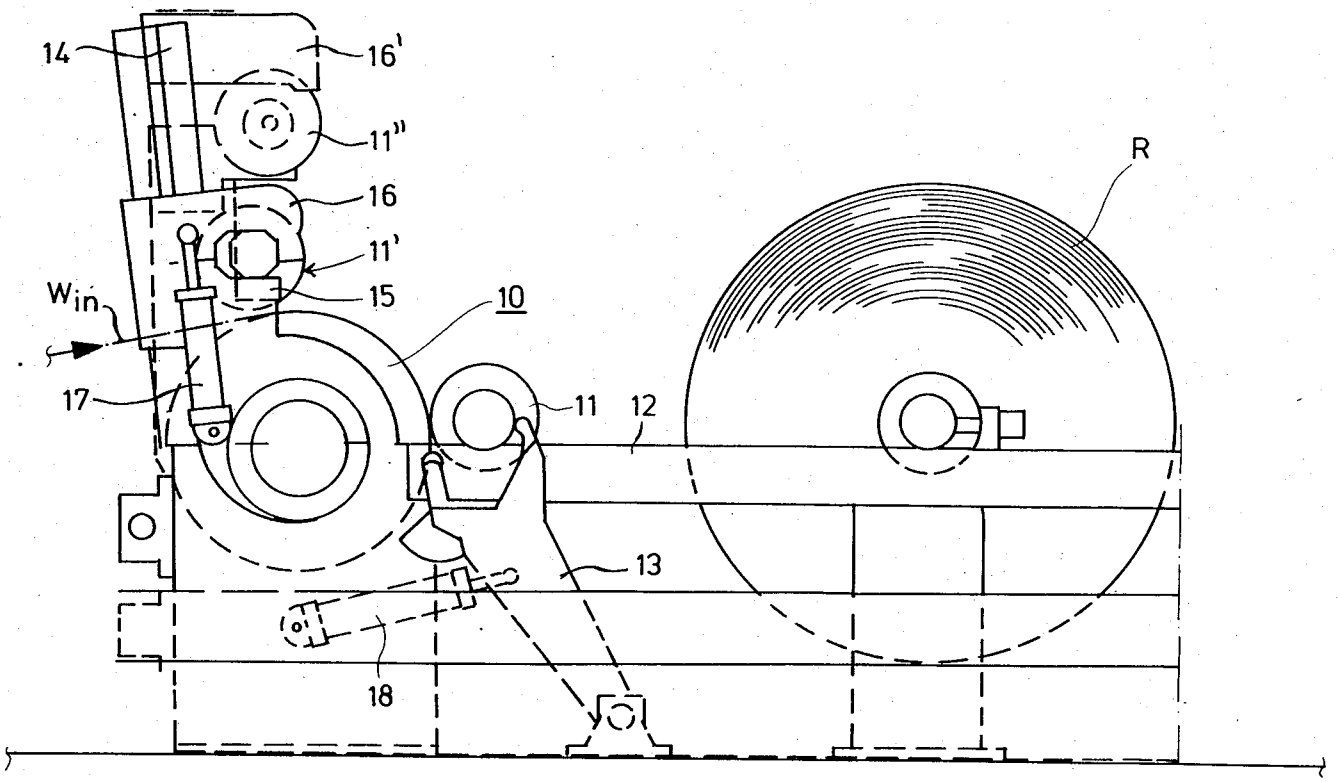
FIG. 1 is a schematic side elevation view of a Pope-type reel-up apparatus in which a method in accordance with the invention can be used.

Referring to FIG. 1, paper web reel-up apparatus are illustrated wherein a reeling cylinder, i.e., a Pope cylinder, 10 provides operating power to the periphery of a web reel $R_0$ being formed on a reeling drum 11' by a friction nip N (FIG. 2) formed between them. The initial stage of the reeling operation is shown with the reeling drum 11' in the position shown in FIG. 2 wherein the reeling drum 11' is supported in and loaded by the primary forks 15 and 16. The primary fork 16 is guided on guide bars 14 for movement towards and away from fork 15. As the reeling operation proceeds, the primary forks 15 and 16 and guide bars 14 turn downwardly in the direction of arrow A (FIG. 2) in a manner such that the reeling drum 11' is eventually moved into a position wherein it is supported by reeling rails 12 and secondary forks 13. The paper web entering the reel-up apparatus is designated $W_{in}$ in FIGS. 1–3. In the final stage of the reeling operation, the reeling drum 11 and paper web being wound thereon lie and rotate on reeling rails 12 while the secondary forks 13 press the drum 11 and paper web $R_1$ formed thereon against the reeling cylinder 10 as seen in FIG. 3. The secondary forks 13 also function to separate the paper reel R from the reeling cylinder 10 when the diameter of the paper reel R reaches its desired value.

The completed paper reels R are carried by cranes for further processing. Empty reeling drums are then stored on storing rails (not shown) installed over the supporting rails 12.

The guide bars 14 of the reeling-drum exchange apparatus extend upwardly from the sides of the reeling cylinder 10 and are pivoted at their bottom ends in suitable bearings. The reeling drum 11' is held at its respective ends within a gap formed between the bottom primary fork 15 which is fixed on the guide bars 14 and the top primary fork 16 which is movably mounted on the guide bars 14.

The reel-up apparatus includes loading equipment which in the illustrated embodiment comprises power cylinders 17, 18 and 19, the latter acting on the opposite ends of the reeling drums 11. The loading cylinders 17, 18 and 19 may be either pneumatic or hydraulic cylinders or other conventional power units which operate by pressurized medium or in some cases by electricity. In the latter case, the pressures $P_0$, $P_1$ and $P_2$ referred to below will be understood as corresponding to analogous electrical quantities.

In a conventional Pope-type reel-up apparatus, the exchange of a reeling drum is carried out by lifting the reeling drum 11' by a crane over the bottom primary fork 15 and the top primary fork 16 is lowered from a position 16' (FIG. 1) to the position 16 to load the reeling drum 11'. Thereafter, the reeling drum is accelerated with a separate preliminary starting device (not shown) to a rotational speed which is as close as possible to the rotational speed of the periphery of the reeling cylinder 10. After the acceleration has been completed, the guide rails 14 are pivoted in the direction of rotation of the reeling cylinder 10 whereupon the distance between the reeling drum 11' and the reeling cylinder 10 is reduced due to the eccentric mounting of the guide rail 14, to the point where the drum 11' contacts the paper web W which runs on the top of the reeling cylinder 10. The reeling drum then starts rotating at precisely the same speed as the reeling cylinder.

The weight of the reeling drum 11' and the load created by the top fork 16 are at this point removed from the bottom fork 15 to the reeling cylinder 10 whereupon the web W can be exchanged onto the new drum as described above.

The essential features and functioning of the reeling apparatus described above are conventional and the foregoing description is intended to facilitate the understanding of the invention described below. However, it should be understood that the invention can be utilized in reel-up apparatus whose structure and operation substantially differ from that described above.

Figure 2:
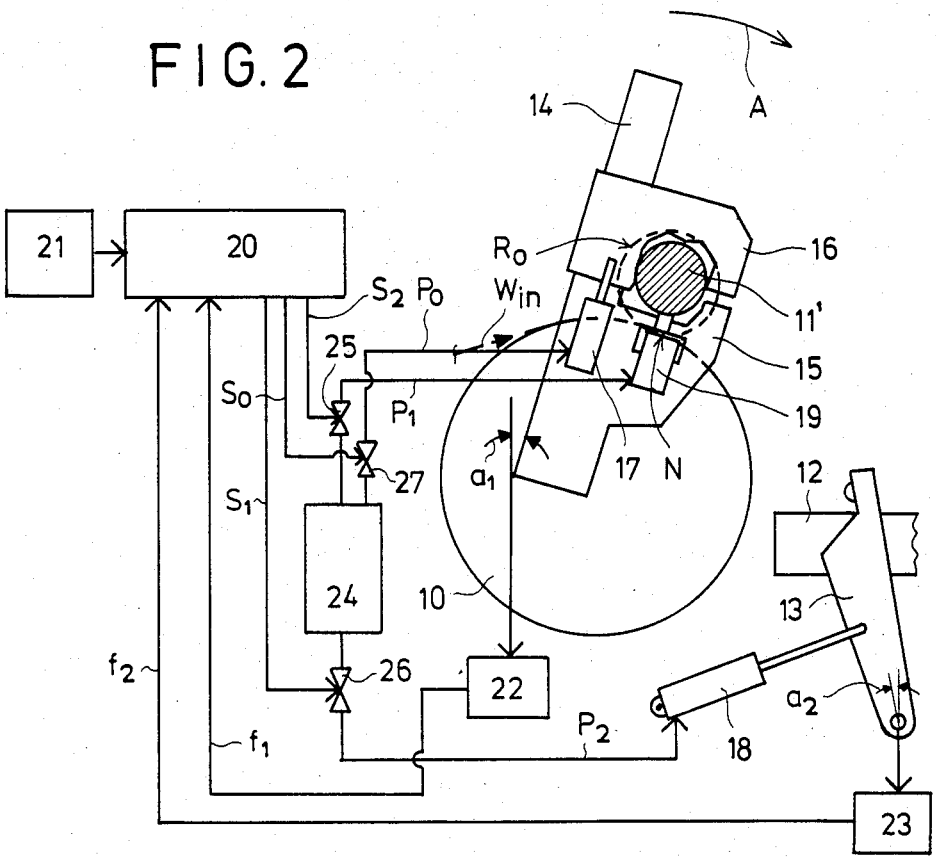
FIG. 2 is a schematic side elevation view of a Pope-type reel-up apparatus in an initial reeling phase and including a block diagram of a control system for performing a method in accordance with the invention.
Figure 3:
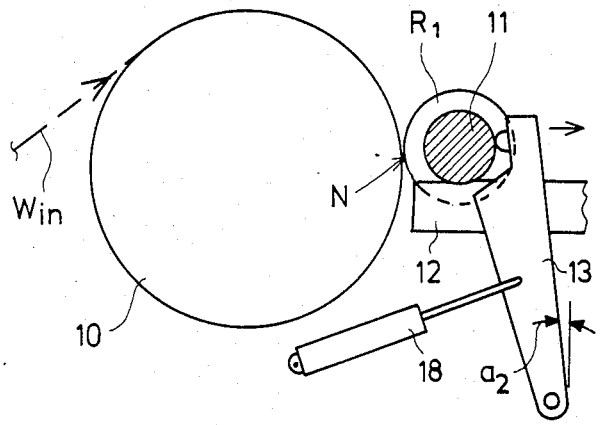
FIG. 3 is a schematic side elevation view of a Pope-type reel-up apparatus at a stage in which the reeling drum and the inner section of the web reel being formed thereon are moved to a position wherein the same are supported by the secondary forks.
Figure 4:
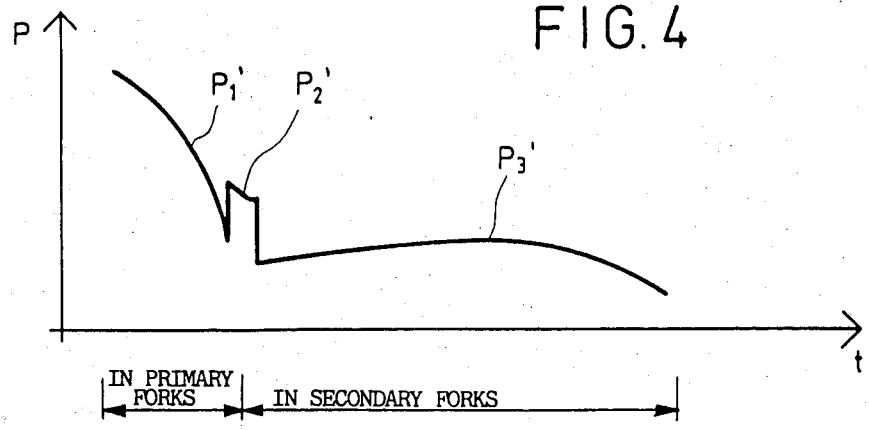
FIG. 4 is a graphical illustration of a load distribution of a Pope-type reel-up apparatus showing the load in the primary forks and in the secondary forks wherein no unloading systems or special controls in accordance with the present invention are utilized.

Referring to FIG. 2, the stage of the reeling-up operation wherein a paper web $W_{in}$ has just been moved from a completed reel R to an empty reeling drum 11' is illustrated. The reeling drum 11' is located against the reeling cylinder 10 under its own weight in combination with the loading forces provided by the twin-loading cylinders 17 of the primary forks 15 and 16. After the reel exchange, the reeling drum 11' begins to decend from the position shown in FIG. 2 in the direction of arrow A. In other words, the angle $a_1$ defined between the vertical and the guide rails 14 increases. In prior art conventional reel-up apparatus, the loading due to the weight of the reeling drum 11' and the inner section of the web reel $R_0$ becomes smaller as seen by the curve portion designated $P'_1$ in FIG. 4. In some conventional reel-up apparatus, unloading cylinders are used for maintaining an even loading through reductions in their pressure.

After the reeling drum 11 has been lowered onto the the reeling rails 12, the loading cylinders 17 of the primary forks 15 and 16 and the loading cylinders 18 of the secondary forks 13 simultaneously load the reeling drum 11 (FIG. 3) for a short period. At this time, in all conventional known reel-up apparatus, an instantaneous "spike" exists in the loading of nip N as seen by the curved portion designated $P'_2$ in FIG. 4. It is this loading spike $P'_2$ that causes the problems in the reeling-up operation which the present invention intends to eliminate. As the diameter of the web reel $R_1$, in the position shown in FIG. 3, increases, the loading of the nip N has, in the case of conventional reel-up apparatus, been as shown by the curved section $P'_3$ of FIG. 4. In this phase of operation, the reeling drum 11 moves on to the reeling rails 12, the angle $a_2$ formed between the secondary forks 13 and the vertical changing during operation. Due to variations of the loading geometry, mainly due to changes of the angle formed between the secondary fork 13 and the loading cylinders 18, the linear loading $P'_3$ of the nip N has varied considerably thereby contributing to the drawbacks described above.

The foregoing is a description of a conventional paper reeling method known in the prior art and on which the present invention is based. In the following, a method in accordance with the invention is described with reference to the construction and operation of the apparatus illustrated in FIGS. 2, 3, 5 and 6.

It is an object of the invention to provide an arrangement in which the linear loading P of the nip N of the reel-up apparatus can be adjusted in a controlled manner during all of the steps of the reeling operation so that the drawbacks described above are eliminated. In the graphical illustration of FIG. 6, the steps of the reeling operation are divided into three stages, namely, I. a first reeling stage during which the web is reeled onto the reeling drum supported in primary forks 14, 15 and 16;

II. a second stage of exchanging the reeling drum 11' and web being reeled thereon from the primary forks 14, 15 and 16 to the secondary forks 13; and III. a third stage of reeling the web reel onto the reeling drum supported in the secondary forks 13.

Figure 6:
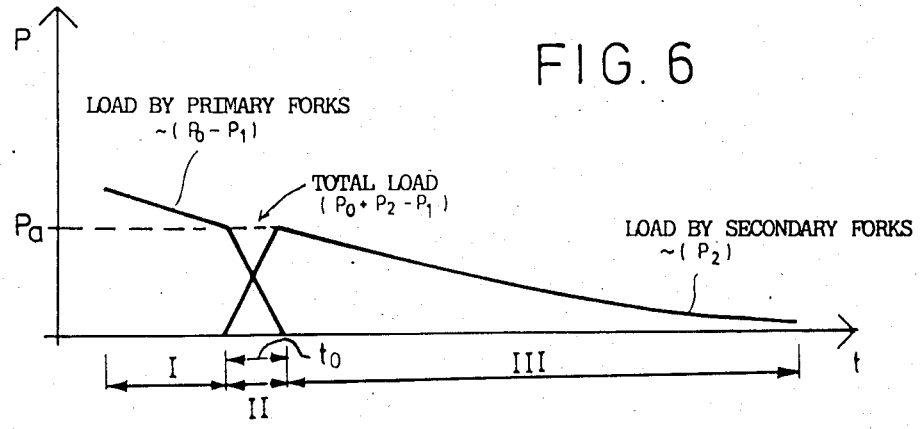
FIG. 6 is a graphical illustration illustrating the load components of the primary and secondary forks, and a combination thereof, which result in the load distribution graphically illustrated in FIG. 5.

More particularly, in the first step I, a pressure $P_0$ of the loading cylinders 17 of the primary forks 14, 15 and 16 is maintained substantially constant (the same pressure $P_0$ being maintained in both cylinders of a twin-cylinder unit). The position of the reeling drum 11', shown in FIG. 2 on the periphery of the Pope cylinder 10, i.e., angle $a_1$, is measured and the pressure $P_1$ of the unloading cylinders 19 is changed in a manner to obtain a linearly descending curve $P_0$–$P_1$ as seen in FIG. 6 in the section designated I. The pressure of the unloading cylinders 19 can also be adjusted in accordance with the value of the angle $a_1$.

In the second stage II, the pressure $P_1$ of the unloading cylinders 19 is controlled to substantially zero or at least to a relatively low level, whereupon the pressure $P_0$ of loading cylinders 17 is reduced essentially linearly during a time period $t_0$ to a substantially zero value, the time period being, for example, about 10 seconds. During the same time period $t_0$ the pressure $P_2$ of the loading cylinders 18 of the secondary forks 13 is raised substantially linearly to a certain initial value $P_a$. Therefore, during the exchange step II, the total load $(P_0+P_2-P_1)$ will be obtained as shown by the dotted line in the curve section II of FIG. 6 which is seen to be a substantially constant value $P_a$. The spike region $P'_2$ of FIG. 4 and the consequent drawbacks thereof are eliminated.

In the third step III of the operation, illustrated in FIG. 3, the angle $a_2$ is measured and the pressure of the loading cylinders 18 of the secondary forks 13 is adjusted in accordance with the measuring signals $f_2$ (FIG. 2) in a manner such that the pressure $P_2$ of nip N descends in a substantially linear manner as the diameter of the web reel $R_1$ increases. The pressure of the loading cylinder 18 can also be adjusted in any other manner so as to descend substantially linearly.

Figure 5:
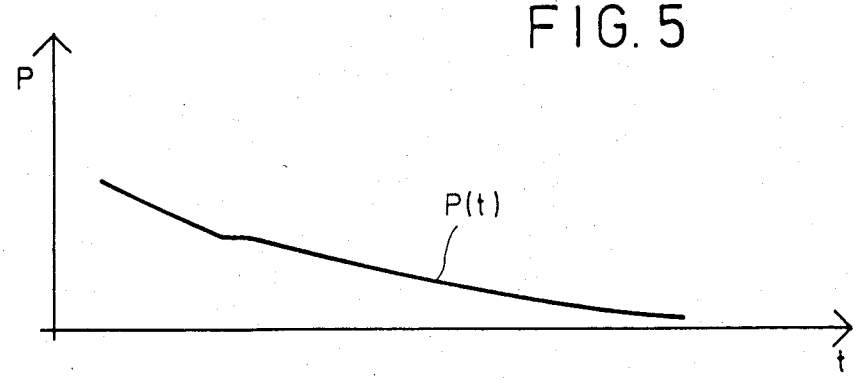
FIG. 5 is graphical illustration of the load distribution of Pope-type reel-up apparatus as a function of time when a control system and method in accordance with the invention are utilized.

As seen in FIG. 5, the steps I, II and III of the reeling operation produces a loading distribution P(t) of the reeling nip N which descends or otherwise changes in a substantially even manner without any spike as a function of the reeling time t and the radius of the web reel.

A novel feature of the invention is that a sort of "flexible exchange" is obtained when removing the web reel from the primary forks 15, 16 to the secondary forks 13, i.e., during the controlled exchange step II described above.

An embodiment of a control system for performing a method in accordance with the invention is illustrated in FIG. 2 in block diagram form. In embodiments in practice, the control equipment may differ considerably from that shown in FIG. 2.

Referring to FIG. 2, a control system in accordance with the invention comprises a central unit 20 which may comprise in practice several separate devices. The unit 20 is controlled by a programmable control logic 21 or some other similar system, such as one based on microprocessors. The control system comprises conventional sensor devices 22 and 23, sensor device 22 measuring the position of the primary forks 14, 15 and 16, i.e., the angle $a_1$, while the second sensor device 23 measures the position of the secondary fork 13, i.e., the angle $a_2$. Sensors 22 and 23 generate measuring signals $f_1$ and $f_2$ which are conducted to the central unit 20 which transmits adjusting signals $S_0$, $S_1$ and $S_2$ to pressure regulating valves 25, 26 and 27 which control pressures $P_0$ and $P_1$ transmitted from pressure sources 24 to loading cylinders 17 of the primary forks 14, 15 and 16 and to unloading cylinders 19 of the primary forks, as well as pressure $P_2$ directed to loading cylinders 18 of the secondary forks. Accordingly, control signals $f_1$ and $f_2$ control pressure $P_0$, $P_1$ and $P_2$ according to a program set by means of the control logic 21 in a manner such that a "smooth" loading distribution curve P(t) as shown in FIG. 5 or the like is obtained.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A method for controlling a paper web reeling operation in reeling apparatus including a reeling drum around which a paper web reel is wound and a reeling cylinder for transmitting power required for reeling to the paper web reel mainly through a nip formed between the periphery of said reeling cylinder and the periphery of the paper web reel being formed, and wherein the reeling operation is begun with said reeling drum supported in primary forks from which said reeling drum and an inner section of the paper web reel wound therearound are transferred to secondary forks in which the reeling operation is completed, and wherein power equipment is coupled to said primary and secondary forks for loading the nip between said reeling cylinder and the paper web reel, comprising the steps of:

generating a first control signal determined by the position of the primary forks;

generating a second control signal determined by the position of the secondary forks;

transmitting said control signals to control means for said power equipment; and controlling said power equipment by said control means based on said first and second control signals transmitted thereto so that the load distribution of the nip with respect to time is substantially linear during the reeling operation including an exchange step wherein said reeling drum and inner section of the paper web reel wound therearound are transferred from the support of said primary forks to be supported and loaded by said secondary forks.

2. The method of claim 1 wherein said controlling step comprises controlling said power equipment so that the substantially linear load distribution of the nip with respect to time during the reeling operation is substantially continuously decreasing.

3. The method of claim 1 wherein said power equipment coupled to said primary forks comprises loading cylinders coupled to ends of said reeling drum for creating a loading pressure and unloading cylinders for creating an unloading pressure opposite to the loading pressure of said loading cylinders.

4. The method of claim 3 wherein during an initial step of the reeling operation wherein said reeling drum and inner section of the paper web reel wound therearound is supported by said primary forks, maintaining said loading pressure created by said loading cylinders substantially constant, and varying said unloading pressure created by said unloading cylinders so that a controlled loading of the primary forks is provided in said initial step of the reeling operation.

5. The method of claim 1 wherein during said exchange step of the reeling operation wherein said reeling drum and inner section of the paper web reel wound therearound is transferred from the support of said primary forks to be supported and loaded by said secondary forks, decreasing the loading of said primary forks from a certain level to a level substantially close to zero over a certain time interval and simultaneously increasing the loading of said secondary forks from a level substantially close to zero substantially to said certain level over said certain time interval such that a substantially constant loading is provided during such exchange step.

6. The method of claim 3 wherein during an initial stage of said exchange step wherein said reeling drum and inner section of the paper web reel wound therearound is transferred from the support of said primary forks to be supported and loaded by said secondary forks, the loading pressure created by said unloading cylinders of said primary forks is substantially zero.

7. The method of claim 1 wherein during a step of the reeling operation subsequent to said exchange step and wherein said reeling drum and paper web reel wound therearound are supported and loaded by said secondary forks, controlling said power equipment so that the load distribution of the nip with respect to time is substantially linear as the size of the paper web reel increases.

8. The method of claim 1 wherein the positions of said primary and secondary forks and thereby the position of the paper web reel with respect to said reeling cylinder are sensed by position sensor means for providing said first and second control signals which are transmitted to said control means, and wherein said control means generate signals for controlling said power equipment.

9. The method of claim 1 wherein said method includes controlling said control means by a programmable control logic means.

* * * * *

US004634068B1

REEXAMINATION CERTIFICATE (3209th)

United States Patent [19]

Malkki et al.

[11] B1 4,634,068

[45] Certificate Issued Jun. 3, 1997

[54] METHOD FOR CONTROLLING PAPER WEB REEL-UP

[75] Inventors: Raimo Malkki, Lappeenranta; Antti Kuisma, Jyväskylä ; Matti Verkasalo, Oulu, all of Finland

[73] Assignees: Valmet Oy, Helsinki; Oy Kaukas AB, Lappeenranta, both of Finland

Reexamination Request:
No. 90/004,228, Apr. 23, 1996

Reexamination Certificate for:

| | |
|---|---|
| Patent No.: | **4,634,068** |
| Issued: | **Jan. 6, 1987** |
| Appl. No.: | **803,106** |
| Filed: | **Nov. 27, 1985** |

[30] Foreign Application Priority Data

Nov. 27, 1984 [FI] Finland ..... 844652

[51] Int. Cl.[6] ..... B65H 18/16

[52] U.S. Cl. ..... 242/541.7; 242/542.3

[58] Field of Search ..... 242/541.4, 541.5, 242/541.6, 541.7, 542.3

[56] References Cited

U.S. PATENT DOCUMENTS

| | | |
|---|---|---|
| 634,479 | 10/1899 | Savery . |
| 1,248,542 | 12/1917 | Pope . |
| 1,951,715 | 3/1934 | Valentine et al. . |
| 2,176,198 | 10/1939 | Berry . |
| 2,475,480 | 7/1949 | Clem et al. . |
| 2,498,224 | 2/1950 | Stone . |
| 2,528,713 | 11/1950 | Thomson . |
| 2,581,242 | 1/1952 | Dickhaut . |
| 2,613,880 | 10/1952 | Post . |
| 2,703,683 | 3/1955 | Evans et al. . |
| 2,872,126 | 2/1959 | Rockstrom et al. . |
| 2,935,272 | 5/1960 | Schmitz . |
| 3,061,221 | 10/1962 | Aulen . |

(List continued on next page.)

FOREIGN PATENT DOCUMENTS

| | | |
|---|---|---|
| 303507 | 11/1972 | Austria . |
| 2532920 | 3/1984 | France . |
| 2541945 | 2/1977 | Germany . |
| 435315 | 11/1974 | U.S.S.R. . |
| 785407 | 12/1980 | U.S.S.R. . |
| 723155 | 2/1955 | United Kingdom . |
| 808759 | 2/1959 | United Kingdom . |
| 809508 | 2/1959 | United Kingdom . |
| 1284196 | 8/1972 | United Kingdom . |
| 1297811 | 11/1972 | United Kingdom . |
| 2147279 | 5/1985 | United Kingdom . |

OTHER PUBLICATIONS

Klemmer, Paul, "All About Reels: A Total Analysis", *Pulp & Paper*, Jun. 20, 1966, pp. 36–41.

Viklund, Gustaf, "Rebuild of Kvarnsveden PM9 A Success," *Svensk Papperstidning*, Apr. 10, 1979, pp. 151–153.

(List continued on next page.)

*Primary Examiner*—John M. Jillions

[57] ABSTRACT

A method for controlling paper web reel-up, particularly in a Pope-type reel-up apparatus, wherein a reeling cylinder provides power to a paper web reel being formed on a reeling drum at a nip formed between the periphery of the reeling cylinder and the periphery of the web reel being formed. The reeling operation is begun with the reeling drum held in primary forks. The reeling drum and inner section of the web reel formed on it are removed from the primary forks and delivered to secondary forks in which the final steps of the reeling operation are carried out. The primary and secondary forks are coupled to power equipment by which the loading of the power-transmitting nip is generated. In accordance with the invention, the nip loading force provided by the power equipment during the reeling operation is adjusted by control signals determined by the position of the primary and secondary forks in a manner such that a substantially even load distribution will occur even in the exchange step in which the reeling drum and web reel being formed on it are moved from the support of the primary forks to the support of the secondary forks.

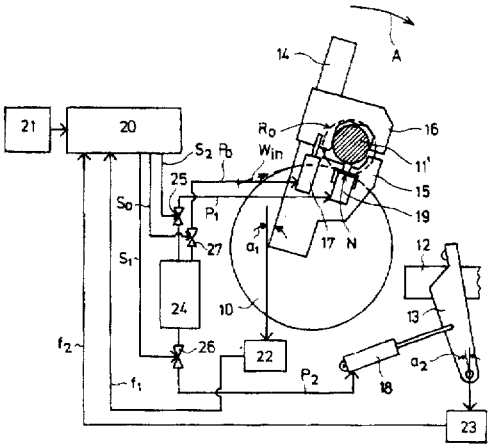

U.S. PATENT DOCUMENTS

| | | |
|---|---|---|
| 3,103,321 | 9/1963 | Jilek . |
| 3,116,031 | 12/1963 | Moore et al. . |
| 3,179,349 | 4/1965 | Aaron et al. . |
| 3,191,883 | 6/1965 | Wells . |
| 3,202,374 | 8/1965 | Phelps . |
| 3,237,877 | 3/1966 | Printz et al. . |
| 3,250,483 | 5/1966 | Printz et al. . |
| 3,258,217 | 6/1966 | MacArthur et al. . |
| 3,380,685 | 4/1968 | Crist et al. . |
| 3,490,712 | 1/1970 | Mukai et al. . |
| 3,586,253 | 6/1971 | Gilbank et al. . |
| 3,592,403 | 7/1971 | Schmitt et al. . |
| 3,610,545 | 10/1971 | Reifenhäuser et al. . |
| 3,614,011 | 10/1971 | Karr . |
| 3,687,388 | 8/1972 | Pfeiffer . |
| 3,743,199 | 7/1973 | Karr et al. . |
| 3,792,820 | 2/1974 | Lucas . |
| 3,796,390 | 3/1974 | Melead . |
| 3,844,502 | 10/1974 | Toy, Jr. . |
| 3,877,654 | 4/1975 | Randpalu et al. . |
| 4,049,212 | 9/1977 | Yamaguchi et al. . |
| 4,111,377 | 9/1978 | Tetro et al. . |
| 4,150,797 | 4/1979 | Kataoka . |
| 4,191,341 | 3/1980 | Looser . |
| 4,374,575 | 2/1983 | Lerch et al. . |
| 4,390,138 | 6/1983 | Rohde et al. . |
| 4,465,243 | 8/1984 | Welp . |
| 4,546,930 | 10/1985 | Rohde et al. . |
| 4,550,882 | 11/1985 | Hutzenlaub et al. . |
| 4,552,317 | 11/1985 | Halter . |
| 4,564,150 | 1/1986 | Keene et al. . |
| 4,565,337 | 1/1986 | Mondini et al. . |
| 4,601,435 | 7/1986 | Tomma et al. . |

OTHER PUBLICATIONS

"Pressure Control in Reel–Up Gear RPC–1", *Nobel Elektronik*, pp. 1–4.

Hadlock, Alan H., "The Principles of Winding," *Pima*, Feb., 1979, pp. 13–16.

Sjöberg, Kjell R., "Rolltrimmer System Improves Control and Paper Quality on Two–Drum Winders," *Paper Trade Journal*, Sep. 15, 1983, pp. 42–45.

Adams, R. J., "The Evolution of Winder Control," *Tappi Journal*, Oct., 1984, pp. 72–75.

Adams, R. J., "The Evolution of Winder Control," *Tappi Journal*, Oct., 1984, pp. 35–40.

Komulainen, Pekka, "Modern Equipment Improves Winder Capacity and Roll Quality," *Paper Trade Journal*, Sep., 1984, pp. 91–94.

70th Annual Meeting, Technical Section, Canadian Pulp & Paper Association, Jan. 31 and Feb. 1, 1984, Montreal, Quebec, pp. A163–A169.

REEXAMINATION CERTIFICATE ISSUED UNDER 35 U.S.C. 307

NO AMENDMENTS HAVE BEEN MADE TO THE PATENT.

AS A RESULT OF REEXAMINATION, IT HAS BEEN DETERMINED THAT:

The patentability of claims 1–9 is confirmed.

* * * * *